US008692634B2

(12) United States Patent
Yuba et al.

(10) Patent No.: US 8,692,634 B2
(45) Date of Patent: Apr. 8, 2014

(54) SWITCH DEVICE AND CONNECTOR

(75) Inventors: Takashi Yuba, Tokyo (JP); Daiei Iwamoto, Tokyo (JP); SeungSeok Beak, Tokyo (JP); Koichi Kiryu, Nagano (JP); Akio Nakamura, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 74 days.

(21) Appl. No.: 13/541,833

(22) Filed: Jul. 5, 2012

(65) Prior Publication Data

US 2013/0037517 A1 Feb. 14, 2013

(30) Foreign Application Priority Data

Aug. 11, 2011 (JP) ..... 2011-176405

(51) Int. Cl.
*H01H 51/22* (2006.01)

(52) U.S. Cl.
USPC ..... 335/202; 200/51.09

(58) Field of Classification Search
USPC ..... 200/51.05, 51.06, 51.09, 51 R, 51.11, 200/51.12; 335/202, 205–207
See application file for complete search history.

(56) References Cited

U.S. PATENT DOCUMENTS

| | | | | |
|---|---|---|---|---|
| 5,959,519 | A * | 9/1999 | Gobel et al. | 335/179 |
| 6,040,750 | A * | 3/2000 | Pfab | 335/156 |
| 7,876,184 | B2 * | 1/2011 | Mikl et al. | 335/126 |
| 2003/0151480 | A1 * | 8/2003 | Orr | 335/78 |
| 2006/0037944 | A1 * | 2/2006 | Morita et al. | 218/140 |
| 2007/0000876 | A1 * | 1/2007 | Morita et al. | 218/140 |
| 2007/0210885 | A1 * | 9/2007 | Nakano et al. | 335/201 |
| 2007/0257752 | A1 * | 11/2007 | Mikl et al. | 335/78 |

FOREIGN PATENT DOCUMENTS

| | | |
|---|---|---|
| JP | 05-082208 | 4/1993 |
| JP | 2003-031301 | 1/2003 |

* cited by examiner

*Primary Examiner* — Gary F. Paumen
(74) *Attorney, Agent, or Firm* — IPUSA, PLLC

(57) ABSTRACT

A switch device includes first and second contacting portions including first and second fixed contacting portions, first and second movable contacting portions and first and second break contacting portions, respectively, the first fixed contacting portion and the second fixed contacting portion being configured to be electrically connected to one of a power source and an electronic device while the first movable contacting portion and the second movable contacting portion are configured to be electrically connected to the other of the power source and the electronic device; and a first magnet and a second magnet configured to generate magnetic fields between the first fixed contacting portion and the first movable contacting portion and between the second fixed contacting portion and the second movable contacting portion, respectively.

12 Claims, 17 Drawing Sheets

SWITCH DEVICE AND CONNECTOR

BACKGROUND OF THE INVENTION

1. Field of the Invention

The present invention relates to a switch device and a connector.

2. Description of the Related Art

Generally, an electrical or electronic device is driven by supplying electric power from a power source of the like. When supplying the electric power from the power source or the like, the electric power is supplied to the electrical or electronic device through connectors. The connectors for connecting the electrical or electronic device and the power source may be a combination of a jack type connector and a plug type connector configured to be fitted in the jack type connector, as described in Patent Documents 1, Patent Documents 2 and the like.

Recently, as a countermeasure for global warming or the like, supplying of electric power of a direct current with a high voltage has been considered even for the power transmission in a local area. By using the electric power of a direct current with a high voltage, the power loss at the conversion of the voltage, the power transmission or the like can be reduced and it is not necessary to use a heavy cable. Especially, as an information device such as a server or the like consumes a large amount of electric power, supplying of the electric power of a direct current with a high voltage is desirable for the information device.

However, if the voltage of the electric power supplied to the electrical or electronic device is high, the electric power may cause some effects on a human body, or some effects on an operation of electronic components.

When such electric power of a direct current with a high voltage is used for an information device such as a server or the like, it is necessary to provide connectors which are different from connectors used for a general-purpose commercial power source of an alternating current. Further, as the connectors may be handled by a human when installing or maintaining the device, it is necessary to care for the effects on the human body or the like as well.

Further, if the electric power supplied from the power source exceeds 100 V or is direct current with a high voltage, when a switch device is incorporated in a connector, a current commercially available switch cannot be used as it is. For example, when the electric power supplied from the power source is direct current with 400 V, it may not be safe to use a switch device, which is currently used for electric power of an alternating current with 100 V as safety and reliability are not ensured.

[Patent Document]

[Patent Document 1] Japanese Laid-open Patent Publication No. H05-82208

[Patent Document 2] Japanese Laid-open Patent Publication No. 2003-31301

SUMMARY OF THE INVENTION

According to an embodiment, there is provided a switch device including a first contacting portion including a first fixed contacting portion, a first movable contacting portion and a first break contacting portion, the first movable contacting portion being configured to selectively contact one of the first fixed contacting portion and the first break contacting portion; a second contacting portion including a second fixed contacting portion, a second movable contacting portion and a second break contacting portion, the second movable contacting portion being configured to selectively contact one of the second fixed contacting portion and the second break contacting portion, the first fixed contacting portion and the second fixed contacting portion being configured to be electrically connected to one of a power source and an electronic device while the first movable contacting portion and the second movable contacting portion are configured to be electrically connected to the other of the power source and the electronic device; and a first magnet and a second magnet configured to generate magnetic fields between the first fixed contacting portion and the first movable contacting portion and between the second fixed contacting portion and the second movable contacting portion, respectively.

According to another embodiment, there is provided a connector for electrically connecting the power source and the electronic device, including the above switch device; and a first fitting terminal and a second fitting terminal to be fitted with terminals of another connector.

Note that also arbitrary combinations of the above-described constituents, and any exchanges of expressions in the present invention, made among method, device, system, and so forth, are valid as embodiments of the present invention.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1:
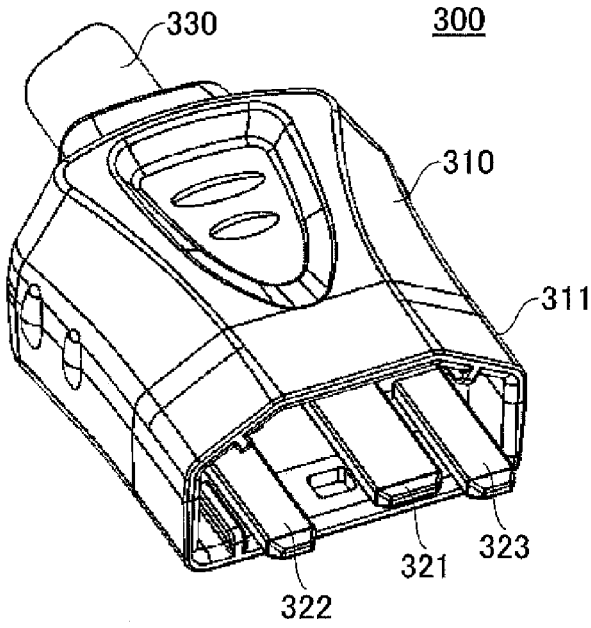
FIG. 1 is a perspective view of an example of a plug connector.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

A switch device and a connector of embodiments are configured to correspond to a high voltage. However, in the following embodiments, the expression "high voltage" does not mean a "direct current of over 750 V" which is defined by the electrical equipment technical standards or a "direct current of higher than or equal to 1500 V" which is an international standard defined by the International Electrotechnical Commission (IEC). Instead, the expression "high voltage" means a voltage that exceeds a safety extra low voltage (a direct current of less than 60 V). In other words, the "high voltage" in the following embodiments means a voltage higher than or equal to 60 V.

(First Embodiment)

(Structure of Connector)

The structure of a connector of a first embodiment is explained.

Figure 4:
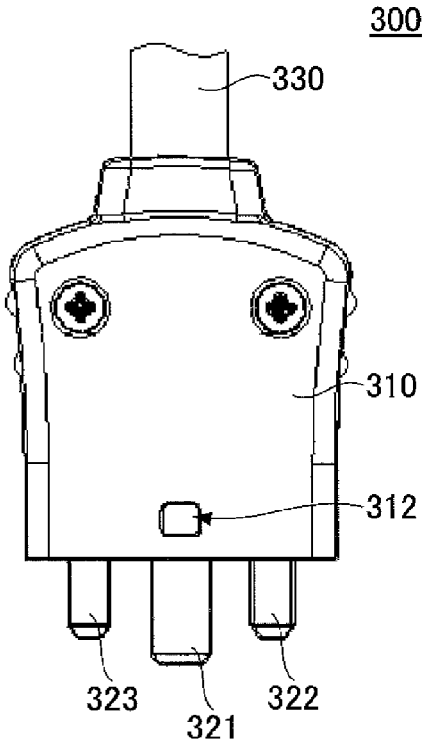
FIG. 4 is a bottom view of an example of the plug connector.
Figure 5:
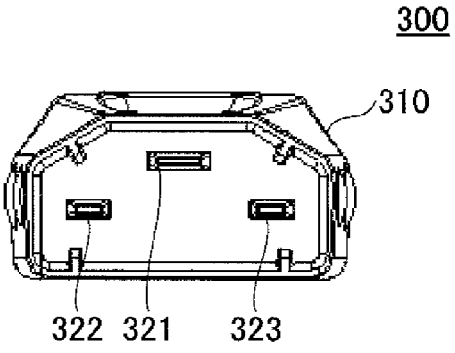
FIG. 5 is an elevation view of an example of the plug connector.
Figure 6:
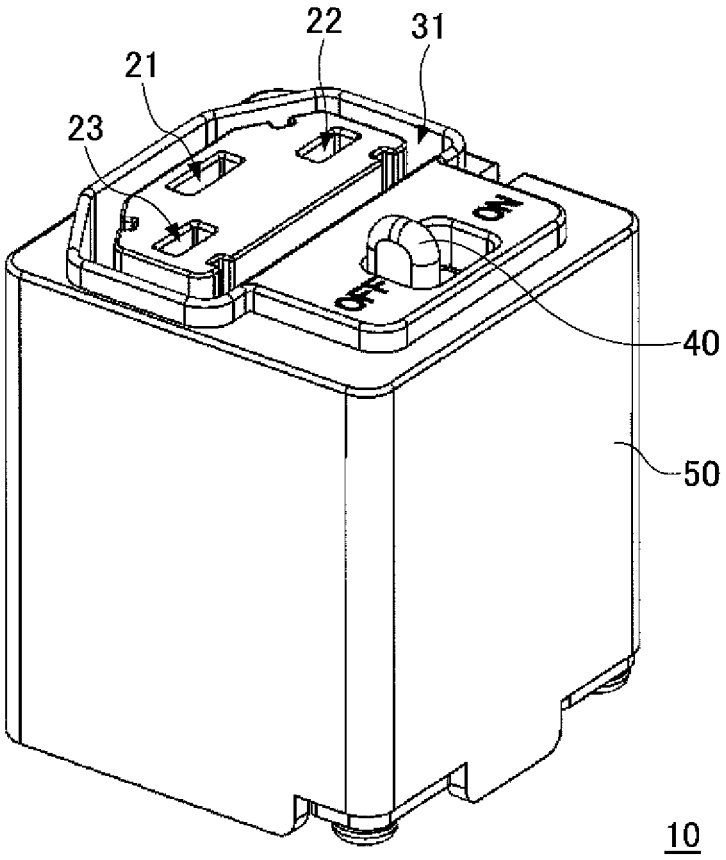
FIG. 6 is a perspective view of an example of a jack connector of a first embodiment.
Figure 7:
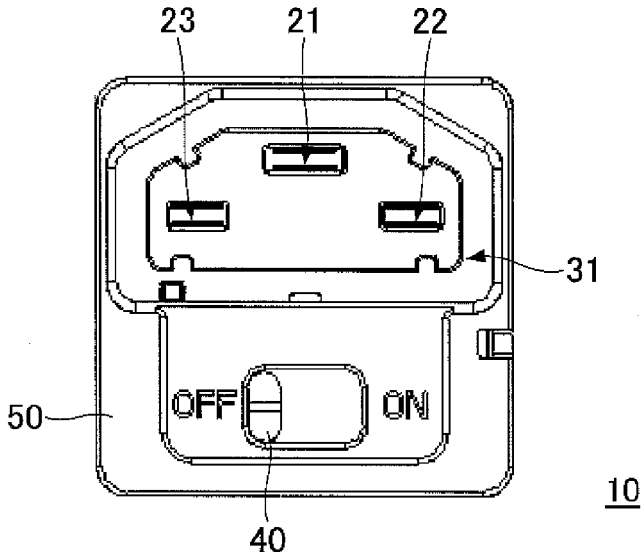
FIG. 7 is an elevation view of an example of the jack connector of the first embodiment.
Figure 8:
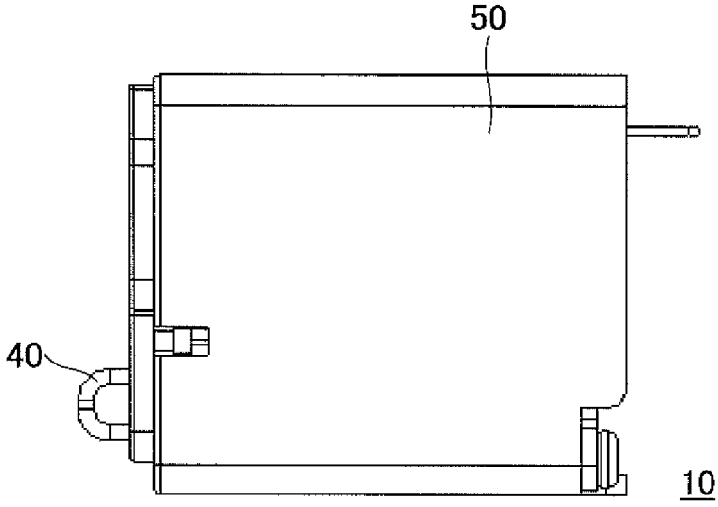
FIG. 8 is a side view of an example of the jack connector of the first embodiment.

The connector of the embodiment is a jack connector 10 shown in FIG. 6 to FIG. 8 which is to be connected to a plug connector 300 (which is an example of another connector) shown in FIG. 1 to FIG. 5. Hereinafter, a connected structure of the plug connector 300 and the jack connector 10 is referred to as a connector as well.

First, the structure of the plug connector 300 is explained with reference to FIG. 1 to FIG. 5.

Figure 2:
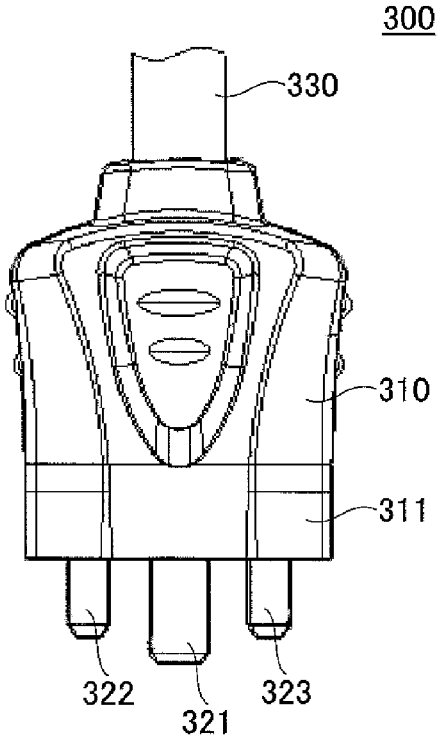
FIG. 2 is a top view of an example of the plug connector.
Figure 3:
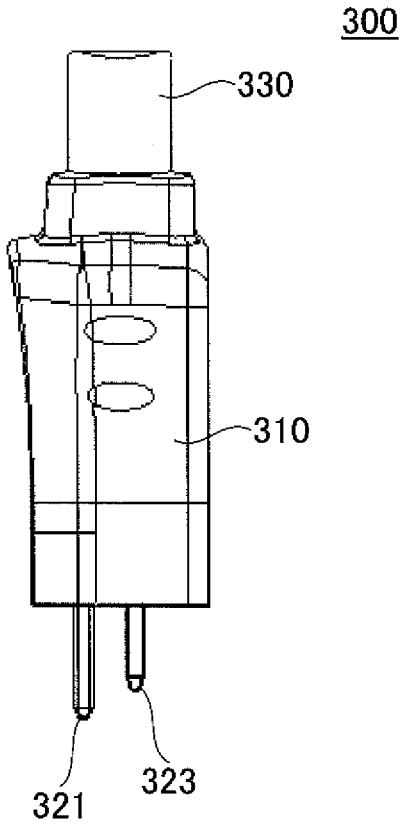
FIG. 3 is a side view of an example of the plug connector.

FIG. 1 is a perspective view of the plug connector 300, FIG. 2 is a top view of the plug connector 300, FIG. 3 is a side view of the plug connector 300, FIG. 4 is a bottom view of the plug connector 300, and FIG. 5 is an elevation view of the plug connector 300.

The plug connector 300 includes a cover 310, three plug terminals 321, 322 and 323, and a cable 330. Further, the cover 310 of the plug connector 300 is provided with a protection portion 311 and an opening 312 (see FIG. 4).

The cover 310 is made of an insulator or the like, for example. The plug terminals 321, 322 and 323 are provided at one side of the cover 310. The plug terminal 321 is a GND terminal and formed to be longer than the plug terminals 322 and 323. The plug terminals 322 and 323 (an example of terminals of the other connector) are configured to be electrically connected to terminals of the jack connector 10 so that electric power is supplied, as will be explained later.

The protection portion 311 is provided at the one side of the cover 310 to surround a part of the plug terminals 321, 322 and 323. The cable 330 is connected to the cover 310 at the other side of the cover 310. In this embodiment, the plug connector 300 is configured to be electrically connected to an electric device via the cable 330. The opening 312 is provided to fix the plug connector 300 with the jack connector 10 when the plug connector 300 is connected to the jack connector 10.

Next, the structure of the jack connector 10 of the embodiment is explained with reference to FIG. 6 to FIG. 8.

FIG. 6 is a perspective view of the jack connector 10, FIG. 7 is an elevation view of the jack connector 10 and FIG. 8 is a side view of the jack connector 10.

The jack connector 10 includes a housing 50 and an operation unit 40. Further, the jack connector 10 is provided with jack openings 21, 22 and 23 to which the plug terminals 321, 322 and 323 of the plug connector 300 are to be inserted, respectively, and a groove portion 31 to which the protection portion 311 of the plug connector 300 is to be inserted. The housing 50 covers the entirety of the jack connector 10. The jack openings 22 and 23 are an example of a first fitting terminal and a second fitting terminal. In this embodiment, as will be explained later, the jack connector 10 is configured to be electrically connected to a power source.

The operation unit 40 is provided to operate a switch device, which will be explained later, for controlling whether to supply electric power from the power source when the plug connector 300 and jack connector 10 are physically connected. The operation unit 40 is slidable between an "ON" position and an "OFF" position. By sliding the operation unit 40, the switch device is operated and whether to supply the electric power from the power source via the jack connector 10 to the plug connector 300 is controlled.

Figure 9:
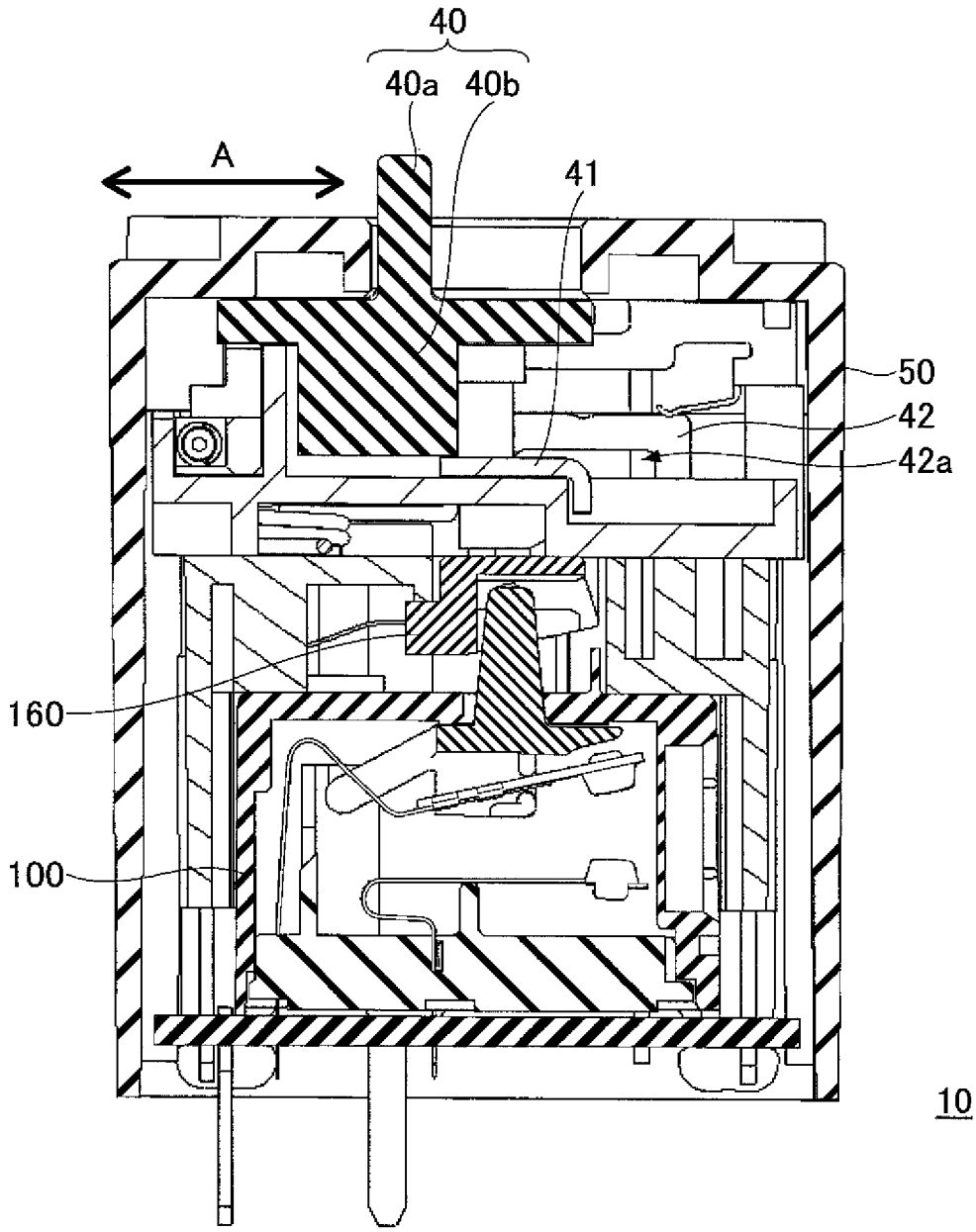
FIG. 9 is a cross-sectional view showing an example of the internal structure of the jack connector of the first embodiment.

The internal structure of the jack connector 10 of the embodiment is explained in detail with reference to FIG. 9. FIG. 9 is a cross-sectional view showing an example of the internal structure of the jack connector 10.

The jack connector 10 further includes a link portion 41, a contact slide portion 42, and a switch device 100.

The switch device 100 includes a button 160 that functions to switch on and off the electrical connection between the jack connector 10 and the plug connector 300, as will be explained later.

The operation unit 40 includes a sliding body portion **40*b* and an operational protruding portion 40*a* which is provided at an upper portion of the sliding body portion 40*b*. The operational protruding portion 40*a* protrudes outside the housing 50 from an opening provided at a top of the housing 50**.

The jack connector 10 is configured such that when the operational protruding portion **40*a* of the operation unit 40 is moved in a direction shown by an arrow "A" (which will be referred to as a sliding direction), the switch device 100 is also operated to switch on and off the electrical connection between the jack connector 10 and the plug connector 300** (in other words, the electrical connection between the electric device and the power source).

The sliding body portion **40*b* is housed in the housing 50 and is connected to the link portion 41**.

The contact slide portion 42 is provided with a slide opening **42*a* and a protruding contacting portion (not shown in the drawings). The protruding contacting portion is formed to extend in a direction (downward direction in FIG. 9) substantially perpendicular to the sliding direction. The protruding contacting portion of the contact slide portion 42 is provided to contact a top of the button 160 of the switch device 100 when the contact slide portion 42 is moved by the link portion 41**.

The slide opening **42*a*** is formed to extend in a direction substantially parallel to the sliding direction.

The link portion 41 is configured to be moved in a direction substantially parallel to the sliding direction. The link portion 41 is formed to have an "L" shape where one end of the "L" shape structure is inserted in the slide opening **42*a* of the contact slide portion 42 to be slidable within the slide opening 42*a*** in the direction substantially perpendicular to the sliding direction.

The plug connector 300 and the jack connector 10 may be configured such that a hook (not shown in the drawings) of the jack connector 10 is fitted to the opening 312 of the plug connector 300 (see FIG. 4) when the operation unit 40 is operated to be positioned at the "ON" position and the electric power is supplied to the plug connector 300. Further, the plug connector 300 and the jack connector 10 may be configured such that the hook of the jack connector 10 is released from the opening 312 of the plug connector 300 when the operation unit 40 is operated to be positioned at the "OFF" position so that the plug connector 300 can be released from the jack connector 10. Further, the jack connector 10 may be configured such that the operation unit 40 cannot be moved to the "ON" position when the plug connector 300 is not physically connected to the jack connector 10, in other words, when the hook (not shown in the drawings) of the jack connector 10 is not fitted to the opening 312 of the plug connector 300.

(Switch Device)

The structure of the switch device 100 is now explained. The switch device 100 of the jack connector 10 functions to control supplying of the electric power from the power source. The switch device 100 may be referred to as a "power switch" as well.

Figure 10:
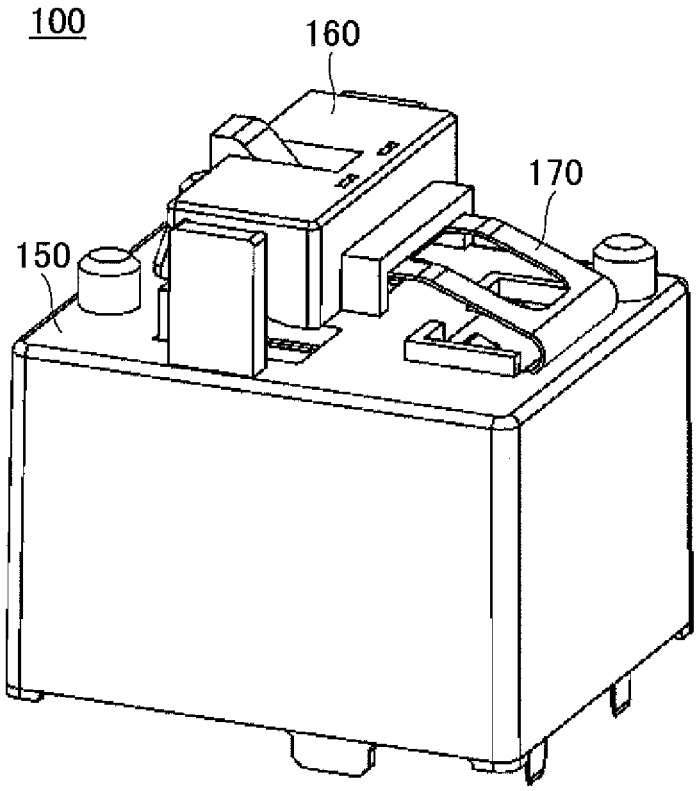
FIG. 10 is a perspective view of an example of a switch device of the first embodiment.
Figure 11:
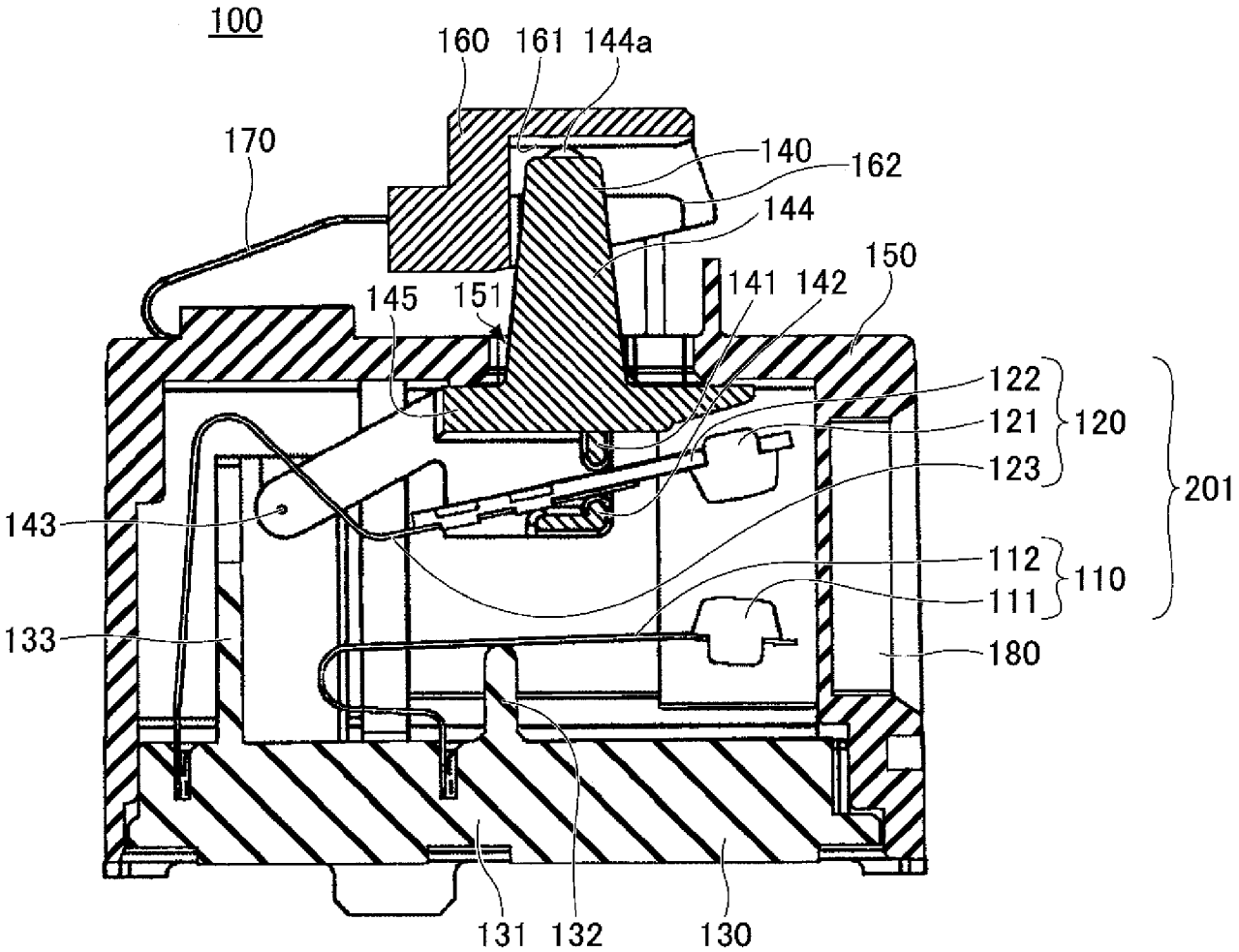
FIG. 11 is a cross-sectional view of an example of the switch device of the first embodiment.

FIG. 10 is a perspective view of an example of the switch device 100. FIG. 11 is a cross-sectional view of the switch device 100 showing an example of the internal structure of the switch device 100.

Referring to FIG. 11, the switch device 100 includes contacting portions 201 including fixed portions 110 and movable portions 120, a base block 130, a card member 140, a switch device housing 150, the button 160, a spring 170 and a magnet unit including permanent magnets 180.

Figure 13:
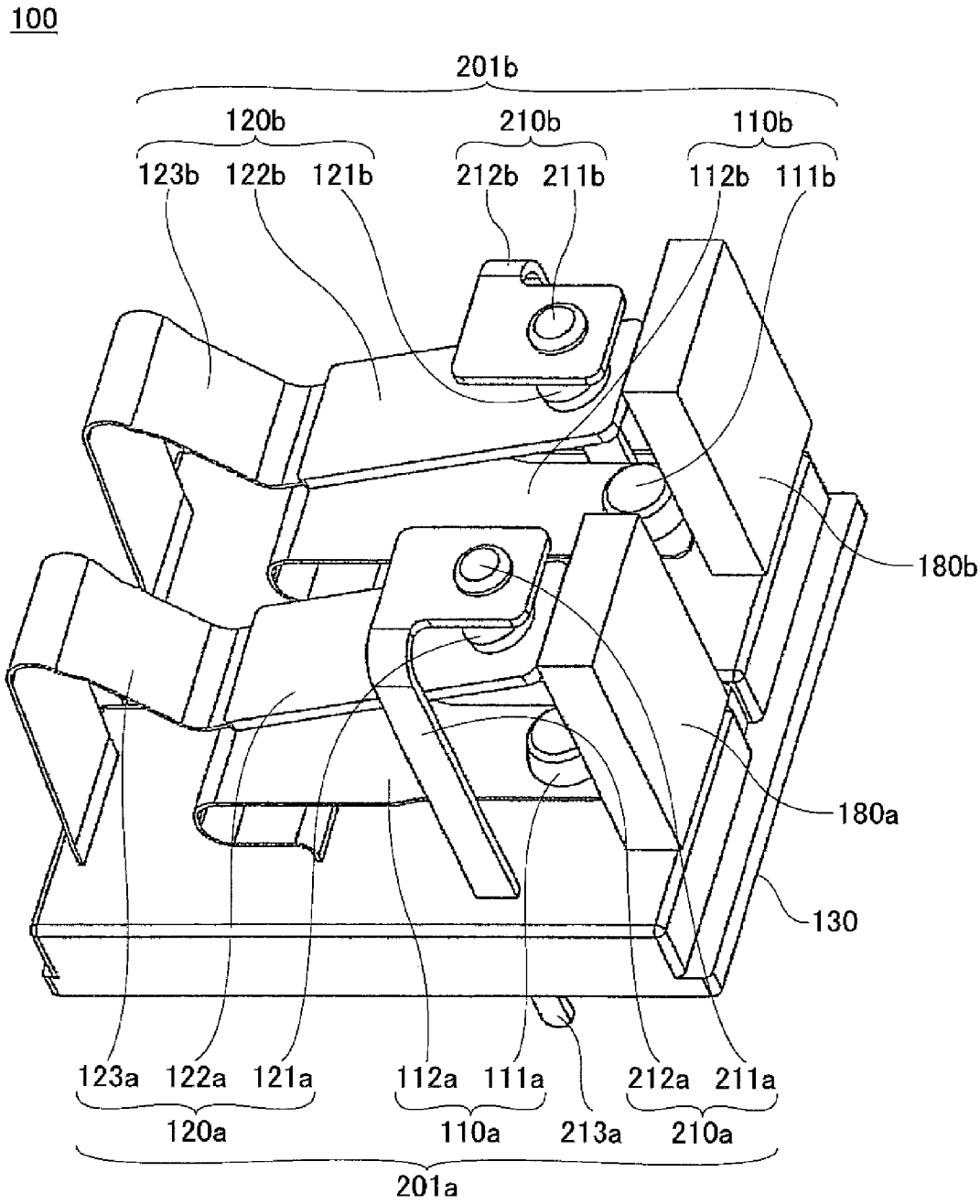
FIG. 13 is a perspective view of an example of the switch device of the first embodiment.
Figure 14:
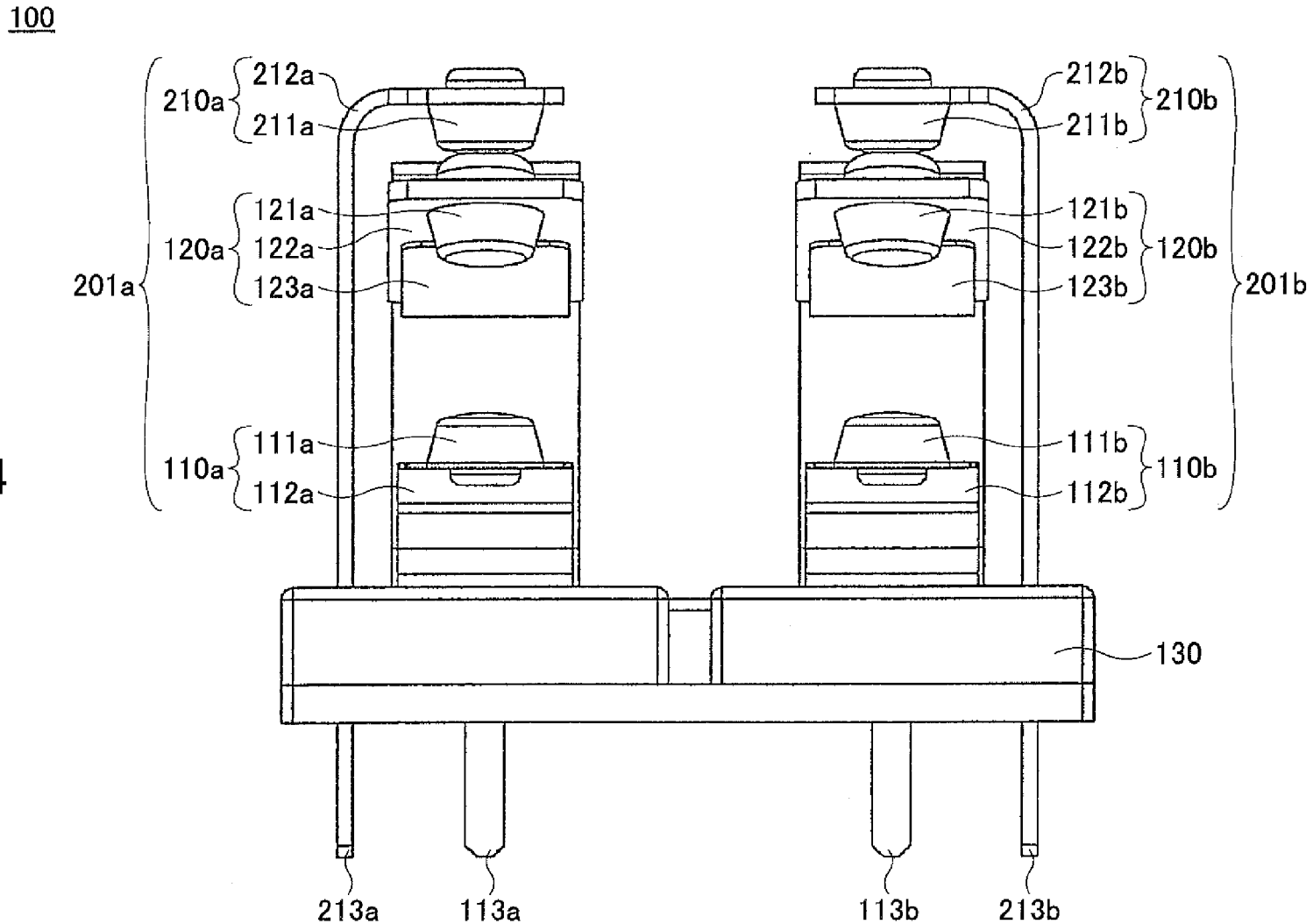
FIG. 14 is an elevation view of an example of the switch device of the first embodiment.

As will be explained later, the switch device 100 of the embodiment includes two of the contacting portions 201 each including the fixed portion 110 (a first fixed portion 110*a* or a second fixed portion 110*b*) and the movable portion 120 (a first movable portion 120*a* or a second movable portion 120*b*), and the permanent magnets 180 (a first permanent magnet 180*a* and a second permanent magnet 180*b*), although only one of each of them is shown in FIG. 10 and FIG. 11 (see also FIG. 13, FIG. 14 and the like).

The base block 130 includes a base block body portion 131, a fixed portion support portion 132 and an insulating wall 133. The insulating wall 133 may be made of fire-retardant resin or the like, for example.

The fixed portions 110 are made entirely of an electrical conductive material such as a metal or the like. Each of the fixed portions 110 includes a fixed spring 112 and a fixed contacting portion 111 provided at one end of the fixed spring 112. The fixed spring 112 may be formed by bending a metal plate or the like made of copper, an alloy including copper or the like, for example. The fixed contacting portion 111 may be made of an alloy including silver and copper, for example. Another end of the fixed spring 112 is fixed at the base block body portion 131 of the base block 130 and the middle part of the fixed spring 112 is supported by the fixed portion support portion 132 of the base block 130.

Similar to the fixed portions 110, the movable portions 120 are made entirely of an electrical conductive material such as a metal or the like. Each of the fixed portions 110 includes a movable plate portion 122, a movable spring 123 and a movable contacting portion 121. The movable contacting portion 121 is provided at one end of the movable plate portion 122 to correspond to the fixed contacting portion 111 of the fixed portions 110 to be contacted. One end of the movable spring 123 is connected to another end of the movable plate portion 122. The movable plate portion 122 and the movable spring 123 may be formed by bending a metal plate or the like made of copper, an alloy including copper or the like, for example. The movable contacting portion 121 may be made of an alloy including silver and copper, for example. Another end of the movable spring 123 is fixed in the base block body portion 131 of the base block 130. As the movable spring 123 is formed by bending the metal plate or the like, for example, the movable spring 123 has flexibility. Thus, the movable contacting portion 121 provided at the one end of the movable plate portion 122 is capable of being moved in an upward and downward direction.

The insulating wall 133 of the base block 130 is provided between a portion where the other end of the fixed spring 112 is fixed and a portion where the other end of the movable spring 123 is fixed. Thus, the movable spring 123 is bent to pass over the insulating wall 133 of the base block 130.

The switch device housing 150 is provided with a switch device opening 151 formed at its upper surface.

The card member 140 includes an upper contacting portion 141, a lower contacting portion 142, a rotating shaft 143, a protruding portion 144, a body portion 145, and a contacting portion 144*a* provided at upper portion of the protruding portion 144.

The card member 140, the base block 130 and the switch device housing 150 may be made of an insulating material such as resin or the like, respectively.

The upper contacting portion 141 of the card member 140 is provided to contact one surface (upper surface in FIG. 11) of the movable plate portion 122 of the movable portion 120, and the lower contacting portion 142 of the card member 140 is provided to contact the other surface (lower surface in FIG. 11) of the movable plate portion 122 of the movable portion 120. In other words, the movable plate portion 122 of the movable portion 120 is sandwiched by the upper contacting portion 141 and the lower contacting portion 142 of the card member 140. Further, the upper contacting portion 141 and the lower contacting portion 142 of the card member 140 are provided to slide on the one surface and the other surface of the movable plate portion 122, respectively. Thus, in order to reduce frictional resistance, the upper contacting portion 141 and the lower contacting portion 142 may be provided with surface layers made of fluorocarbon resin or the like at the surfaces, respectively.

Under this state, when the card member 140 is rotated around the rotating shaft 143, the force is applied to the movable plate portion 122 via the upper contacting portion 141 or the lower contacting portion 142 of the card member 140 so that the movable contacting portion 121 is moved downward or upward, respectively.

The fixed portions 110 and the movable portions 120 are provided within an area surrounded by the base block 130 and the switch device housing 150. The protruding portion 144 of the card member 140 is provided to protrude outside of the switch device housing 150 from the switch device opening 151 of the switch device housing 150. The body portion 145, the upper contacting portion 141 and the lower contacting portion 142 of the card member 140 are provided within an area surrounded by the base block 130 and the switch device housing 150.

The button 160 is provided outside the switch device housing 150 to push the protruding portion 144 of the card member 140 for rotating the card member 140 around the rotating shaft 143. The contacting portion 144*a* of the card member 140 contacts an inner wall portion 161 of the button 160. The contacting portion 144*a* of the card member 140 is provided to slide on a surface of the inner wall portion 161. Thus, in order to reduce frictional resistance, the inner wall portion 161 may be provided with a surface layer made of fluorocarbon resin or the like at the surface.

The spring 170 is provided outside the switch device housing 150. One end of the spring 170 is connected to the switch device housing 150 and the other end of the spring 170 is connected to the button 160.

The switch device 100 is configured to supply the electric power to the plug connector 300 when the fixed contacting portions 111 of the fixed portions 110 and the movable contacting portions 121 of the movable portions 120 are in contact, respectively, and terminate supplying of the electric power to the plug connector 300 when the fixed contacting portions 111 of the fixed portions 110 and the movable contacting portions 121 of the movable portions 120 are not in contact, respectively.

(ON and OFF Operation of Switch Device)

It is assumed that the plug connector 300 and the jack connector 10 are physically connected at this time. Then, when the operation unit 40 is operated to be positioned at the "ON" position, the sliding body portion 40*b* is moved in the sliding direction shown by the arrow "A" (see FIG. 9). With the movement of the body portion 40*b* of the operation unit 40, the link portion 41 is also moved in the sliding direction to move the contact slide portion 42 in the sliding direction as well. Thus, the protruding contacting portion (not shown in the drawings) of the contact slide portion 42 is positioned to push the button 160 of the switching portion downward.

With this operation, the contacting portion 141 of the card member 140 is pushed by the inner wall portion 161 of the button 160 so that the card member 140 is rotated around the rotating shaft 143.

Then, the force is applied to the movable plate portions 122 of the movable portions 120 through the upper contacting portion 141 of the card member 140 in a downward direction so that the movable contacting portions 121 and the fixed contacting portions 111 of the fixed portions 110 make contact, respectively.

Figure 12:
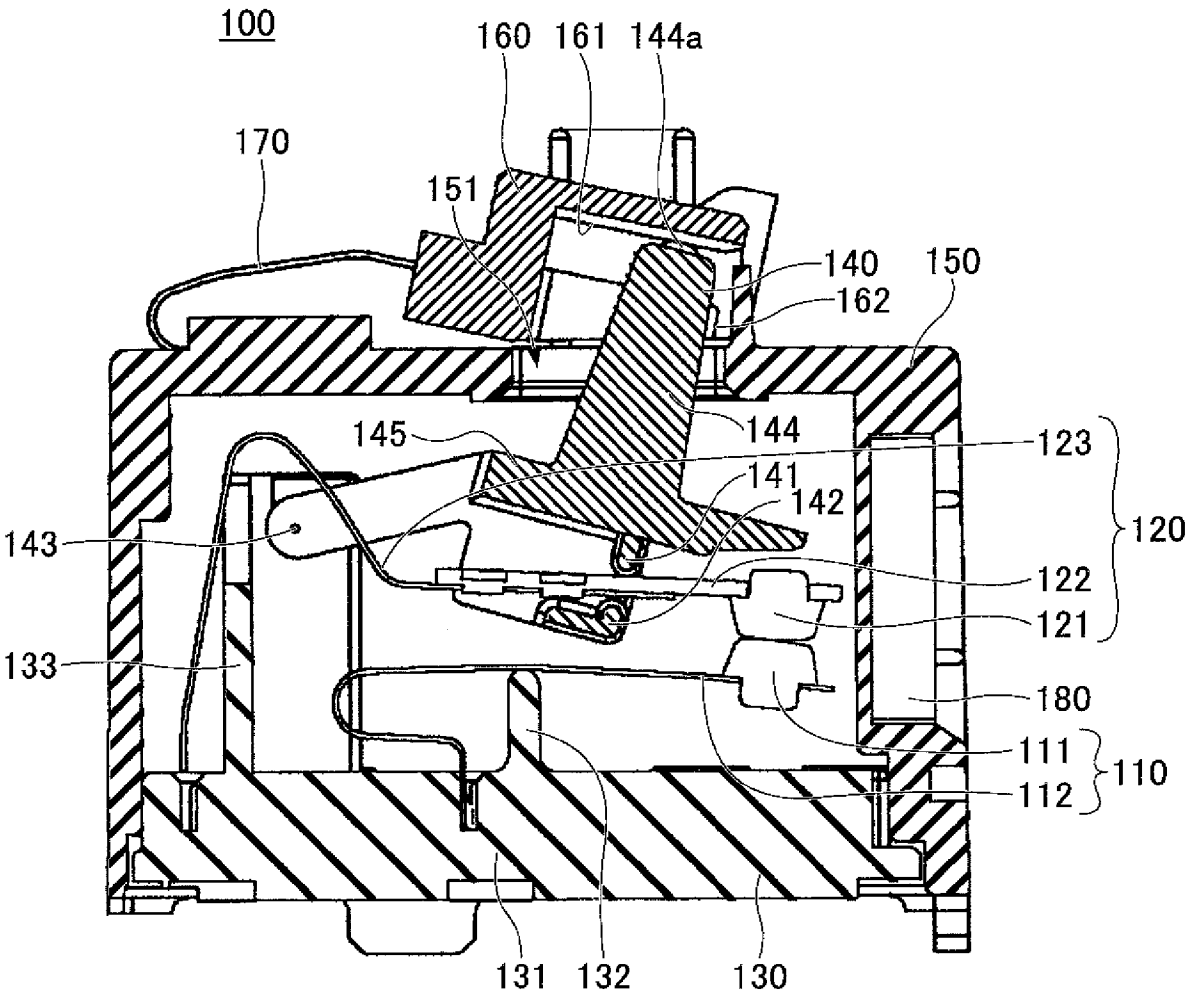
FIG. 12 is a cross-sectional view of an example of the switch device of the first embodiment.

FIG. 12 is a cross-sectional view of the switch device 100 when the fixed contacting portions 111 and the movable contacting portions 121 make contact, respectively.

Although not shown in the drawings, the contact slide portion 42 is configured to maintain this status while the operation unit 40 is positioned at the "ON" position. Thus, the movable contacting portions 121 and the fixed contacting portions 111 are in contact while the operation unit 40 is positioned at the "ON" position so that the electric power is supplied from the power source to the electric device.

Further, when the operation unit 40 is operated to be positioned at the "OFF" position, the contact slide portion 42 is released from pushing the button 160 so that the force applied to the button 160 is released. At this time, the button 160 is moved back in an upper direction by the spring force of the spring 170. With this operation, the card member 140 is rotated around the rotating shaft 143 in the upper direction so that the force in the upward direction is applied to the movable plate portions 122 of the movable portions 120 through the lower contacting portion 142 of the card member 140. Specifically, when the button 160 is moved back in the upper direction, a step portion 162 provided at an inside wall of the button 160 engages with a protruding portion (not shown in the drawings) provided at the card member 140 so that the card member 140 is moved with the button 160 to be rotated around the rotating shaft 143.

Then, the movable contacting portions 121 are moved upward to be apart from the corresponding fixed contacting portions ill to terminate the supply of the electric power from the power source.

At this time, a case may occur where electric arcs are generated between the movable contacting portions 121 and the corresponding fixed contacting portions 111. Thus, according to the switch device 100 of the embodiment, the permanent magnets 180 are provided near contacting areas of the movable contacting portions 121 and the corresponding fixed contacting portions 111 to blow off the electric arcs by magnetic fields. The permanent magnets 180 are provided to generate the magnetic fields in a direction substantially perpendicular to a direction in which the electric arcs are generated.

Alternatively, electro-magnets may be used instead of the permanent magnets 180.

Further, in the switch device 100, the spring force of the spring 170, which is provided outside the switch device housing 150, is used to terminate supplying of the electric power from the power source, instead of using the resilience of the springs of the movable portions 120 such as the movable springs 123 or the like. Thus, even when the movable springs 123 of the movable portions 120 do not have the resilience, supplying of the power source can be terminated.

Here, there is a possibility that heat is generated inside the switch device housing 150 so that the fixed portions 110 and the movable portions 120 may be affected by the heat. However, as the spring 170 is provided outside the switch device housing 150, the spring 170 is not affected by the heat generated inside the switch device housing 150.

Therefore, even in a case when a part of the movable springs 123 or the like is melted by the heat generated inside the switch device housing 150, and the movable springs 123 or the like begin to not function as springs, supplying of the power source can be terminated by the spring force of the spring 170 without using the resilience of the movable springs 123 or the like.

It means that supplying of the electric power from the power source can be surely terminated.

Further, in the switch device 100, the insulating wall 133 is provided at the base block 130 between the portion where the other end of the fixed spring 112 is fixed and the portion where the other end of the movable spring 123 is fixed. With this structure, even when a part of the fixed portions 110 and the movable portions 120 is melted by the heat, the melted portion of the fixed portions 110 and melted portion of the movable portions 120 are separated by the insulating wall 133. Thus, a condition in which the melted portion of the fixed portions 110 and the melted portion of the movable portions 120 make contact so that the current of the power source continues to flow (short of the fixed portion 110 and the corresponding movable portion 120), can be prevented from occurring.

(Structure of Switch Device)

Figure 15:
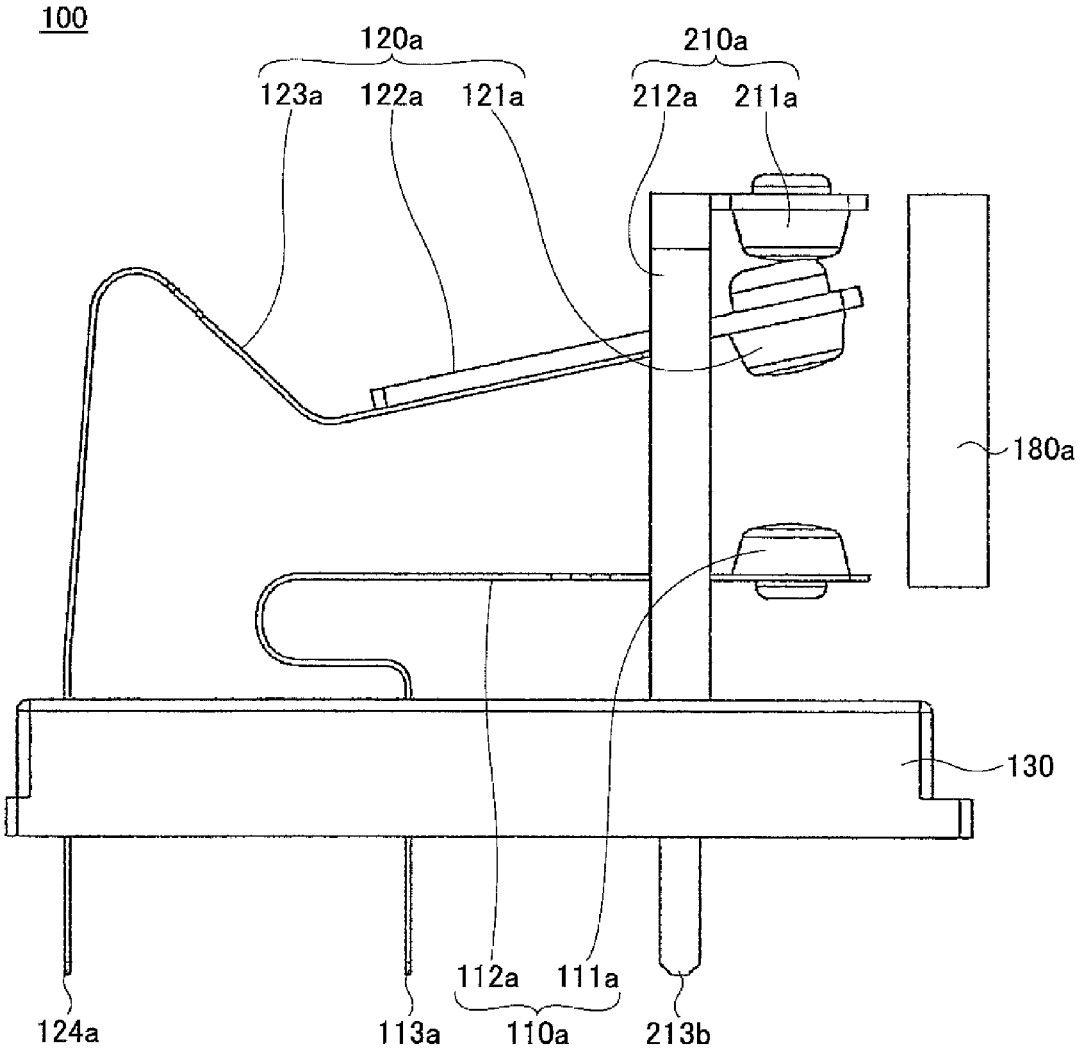
FIG. 15 is a side view of an example of the switch device of the first embodiment.
Figure 16:
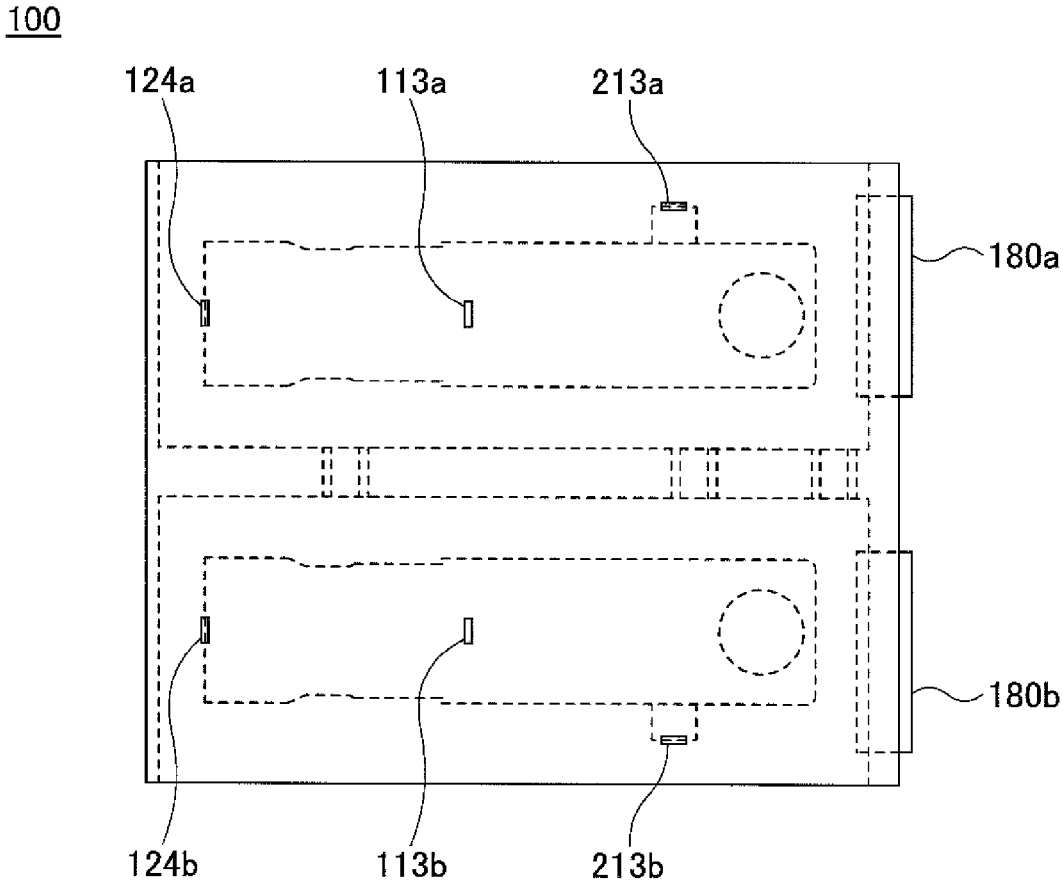
FIG. 16 is a bottom view of an example of the switch device of the first embodiment.

The switch device 100 of the embodiment is explained in detail. FIG. 13 is a perspective view of an example of the switch device 100, FIG. 14 is an elevation view of an example of the switch device 100, FIG. 15 is a side view of an example of the switch device 100 and FIG. 16 is a bottom view of an example of the switch device 100.

As shown in FIG. 13 to FIG. 16, the switch device 100 of the embodiment includes a first contacting portion 201*a* and a second contacting portion 201*b* corresponding to the switching portions 201 and a first permanent magnet 180*a* and a second permanent magnet 180*b* corresponding to the permanent magnets 180. The switch device 100 further includes a fixed portion external terminal 113*a*, a fixed portion external terminal 113*b*, a movable portion external terminal 124*a*, a movable portion external terminal 124*b*, a break portion external terminal 213*a* and a break portion external terminal 213*b*.

The first contacting portion 201*a* includes a first fixed portion 110*a*, a first movable portion 120*a* and a first break portion 210*a*. The second contacting portion 201*b* includes a second fixed portion 110*b*, a second movable portion 120*b* and a second break portion 210*b*. Here, the first fixed portion 110*a* and the second fixed portion 110*b* correspond to the fixed portions 110. The first movable portion 120*a* and the movable portion 120*b* correspond to the movable portions 120.

In the switch device 100 of the embodiment, the electric power from the power source can be supplied to the electronic device when the first fixed portion 110*a* and the first movable portion 120*a* are in contact, as well as when the second fixed portion 110*b* and the second movable portion 120*b* are in contact.

The first fixed portion 110*a* includes a first fixed contacting portion 111*a* and a fixed spring 112*a* which is electrically connected to the fixed portion external terminal 113*a*. Similarly, the second fixed portion 110*b* includes a second fixed contacting portion 111*b*, a fixed spring 112*b* which is electrically connected to the fixed portion external terminal 113*b*. The first fixed contacting portion 111*a* and the second fixed contacting portion 111*b* correspond to the fixed contacting portions 111, and the fixed spring 112*a* and the fixed spring 112*b* correspond to the fixed springs 112.

The first movable portion 120*a* includes a first movable contacting portion 121*a*, a movable plate portion 122*a* and a movable spring 123*a* which is electrically connected to the movable portion external terminal 124*a*. Similarly, the second movable portion 120*b* includes a second movable contacting portion 121*b*, a movable plate portion 122*b* and a movable spring 123*b* which is electrically connected to the movable portion external terminal 124*b*. The first movable contacting portion 121*a* and the second movable contacting portion 121*b* correspond to the movable contacting portions 121, the movable plate portion 122*a* and the movable plate portion 122*b* correspond to the movable plate portions 122, and the movable spring 123*a* and the movable spring 123*b* correspond to the movable springs 123.

The first contacting portion 201*a* and the second the second contacting portion 201*b* of the embodiment have a transfer structure, respectively.

The first break portion 210*a* includes a first break contacting portion 211*a* and a break portion spring 212*a* which is electrically connected to the break portion external terminal 213*a*. The first break portion 210*a* is fixed to the base block 130 by the break portion spring 212*a*. The first break contacting portion 211*a* is provided to face the first fixed contacting portion 111*a* while interposing the first movable contacting portion 121*a* therebetween. The first movable contacting portion 121*a* is configured to selectively contact one of the first fixed contacting portion 111*a* and the first break contacting portion 211*a* to be electrically connected.

Similarly, the second break portion 210*b* includes a second break contacting portion 211*b*, a break portion spring 212*b* which is electrically connected to the break portion external terminal 213*b*. The second break portion 210*b* is fixed to the base block 130 by the break portion spring 212*b*. The second break contacting portion 211*b* is provided to face the second fixed contacting portion 111*b* while interposing the second movable contacting portion 121*b* therebetween. The second movable contacting portion 121*b* is configured to selectively contact one of the second fixed contacting portion 111*b* and the second break contacting portion 211*b* to be electrically connected.

The first break portion 210*a* and the second break portion 210*b* may be made of the material similar to those of the first fixed portion 110*a* and the second fixed portion 110*b*, or the first movable portion 120*a* and the second movable portion 120*b*.

Figure 17:
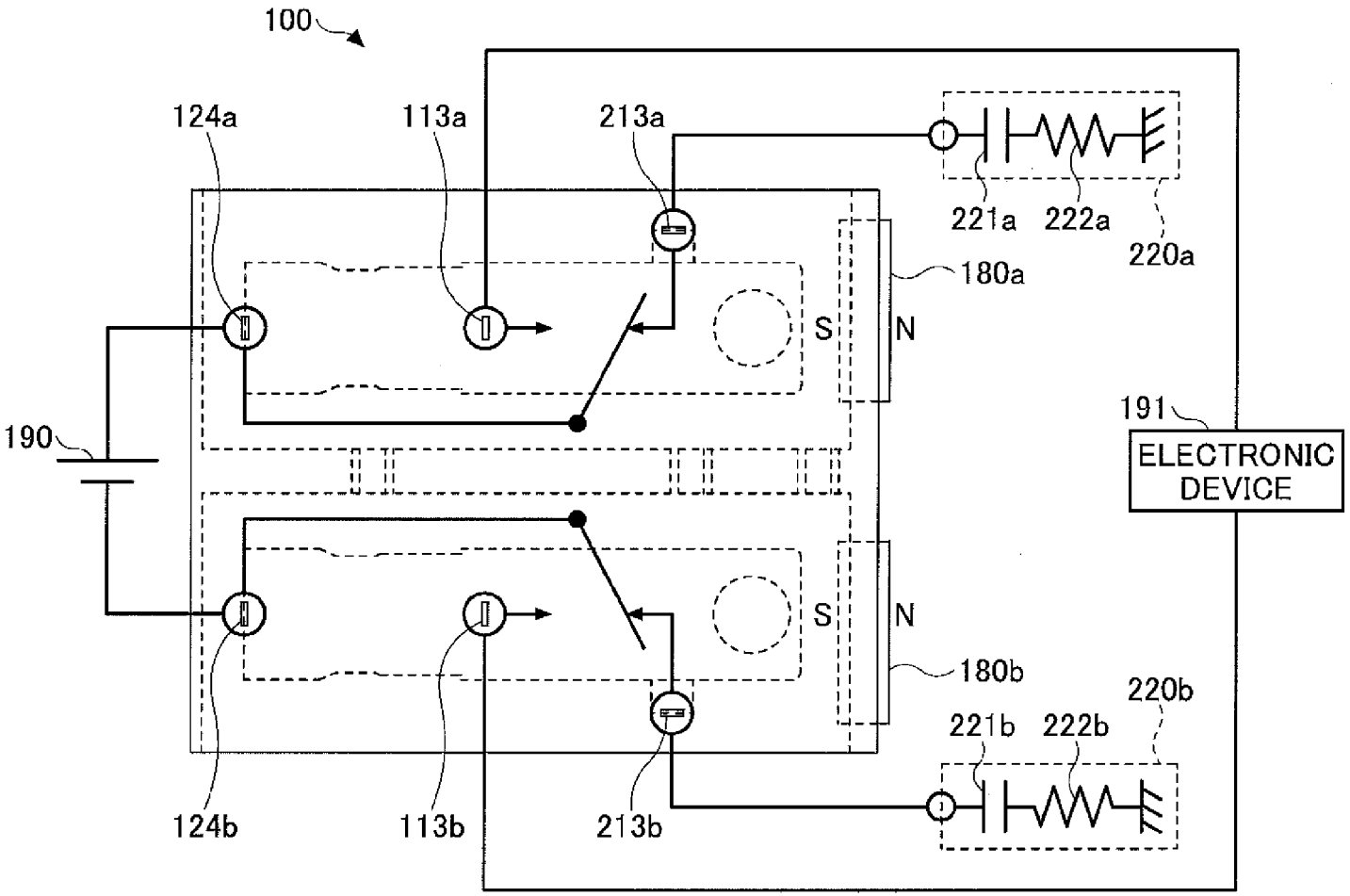
FIG. 17 is a schematic view for explaining an example of the switch device of the first embodiment.

FIG. 17 is a schematic view of an example of the switch device 100, a power source 190 and an electronic device 191.

As shown in FIG. 17, the cathode of the power source 190 is electrically connected to the movable portion external terminal 124*a*, and the anode of the power source 190 is electrically connected to the movable portion external terminal 124*b*, in this embodiment.

Further, the fixed portion external terminal 113*a* is electrically connected to one of the terminals of the electronic device 191 to which the electric power is to be supplied, and the fixed portion external terminal 113*b* is electrically connected to the other of the terminals of the electronic device 191. As described above, in this embodiment, the switch device 100 of the jack connector 10 is electrically connected to the electric device 191 via the plug connector 300 although not shown in FIG. 17.

The first permanent magnet 180*a* is provided to correspond to the first fixed portion 110*a* and the first movable portion 120*a*. The first permanent magnet 180*a* has a function to blow off an electric arc generated between the first fixed contacting portion 111*a* and the first movable contacting portion 121*a* by a magnetic field.

Similarly, the second permanent magnet 180*b* is provided to correspond to the second fixed portion 110*b* and the second movable portion 120*b*. The second permanent magnet 180*b* has a function to blow off an electric arc generated between the second fixed contacting portion 111*b* and the second movable contacting portion 121*b* by a magnetic field.

In this embodiment, the first permanent magnet 180*a* and the second permanent magnet 180*b* are provided such that the directions to blow off the electric arcs generated between the first fixed contacting portion 111*a* and the first movable contacting portion 121*a*, and between the second fixed contacting portion 111*b* and the second movable contacting portion 121*b* become opposite from each other. Specifically, the first permanent magnet 180*a* may be provided such that the electric arc generated between the first fixed contacting portion 111*a* and the first movable contacting portion 121*a* is blown off in an outward direction (a direction opposite to the second contacting portion 201*b*). Similarly, the second permanent magnet 181*b* may be provided such that the electric arc generated between the second fixed contacting portion 111*b* and the second movable contacting portion 121*b* is blown off in an outward direction (a direction opposite to the first contacting portion 201*a*).

Thus, in this embodiment, the first permanent magnet 180*a* and the second permanent magnet 180*b* are provided to generate magnetic fields in the same directions as the current flows between the first fixed contacting portion 111*a* and the first movable contacting portion 121*a*, and between the second fixed contacting portion 111*b* and the second movable contacting portion 121*b*, respectively, in different directions. Specifically, the first permanent magnet 180*a* is placed such that the South Pole faces the side where the first fixed contacting portion 111*a* and the first movable contacting portion 121*a* are provided. Similarly, the second permanent magnet 180*b* is placed such that the South Pole faces the side where the second fixed contacting portion 111*b* and the second movable contacting portion 121*b* are provided.

With this structure, the magnetic field by the first permanent magnet 180*a* is generated between the first fixed contacting portion 111*a* and the first movable contacting portion 121*a*, and the magnetic field by the second permanent magnet 180*b* is generated between the second fixed contacting portion 111*b* and the second movable contacting portion 121*b*. Alternatively, instead of the first permanent magnet 180*a* and the second permanent magnet 180*b*, electro-magnets may be used.

Under a state where the power source 190 and the electronic device 191 are electrically connected, in other words, the first fixed contacting portion 111*a* and the first movable contacting portion 121*a* are electrically connected, as well as the second fixed contacting portion 111*b* and the second movable contacting portion 121*b* are electrically connected, a current is supplied from the cathode of the power source 190 to the movable portion external terminal 124*a*. Then, the current flows through the first movable portion 120*a*, the first fixed portion 110*a* via the first movable contacting portion 121*a* and the first fixed contacting portion 111*a* and the fixed portion external terminal 113*a* in this order to be supplied to the electronic device 191. Then, the current further flows from the electronic device 191 through the fixed portion external terminal 113*b*, the second fixed portion 110*b*, the second movable portion 120*b* via the second fixed contacting portion 111*b* and the second movable contacting portion 121*b*, and the movable portion external terminal 124*b* in this order to reach the anode of the power source 190.

Under a state where the power source 190 and the electronic device 191 are not electrically connected, the electric power from the power source 190 is not supplied to the electronic device 191. Under this state, the first movable contacting portion 121*a* contacts the first break contacting portion 211*a*, and the second movable contacting portion 121*b* contacts the second break contacting portion 211*b*, in this embodiment.

The switch device 100 of the embodiment further includes a first end portion 220*a* and a second end portion 220*b* which are connected to the break portion external terminal 213*a* and the break portion external terminal 213*b*, respectively.

The first end portion 220*a* includes a capacitor 221*a* and a resistor 222*a* which are connected in series. Here, one electrode of the capacitor 221*a* is connected to the break portion external terminal 213*a* and another electrode of the capacitor 221*a* is connected to one end of the resistor 222*a*, and another end of the resistor 222*a* is grounded.

Similarly, the second end portion 220*b* includes a capacitor 221*b* and a resistor 222*b* which are connected in series. Here, one electrode of the capacitor 221*b* is connected to the break portion external terminal 213*b* and another electrode of the capacitor 221*b* is connected to one end of the resistor 222*b*, and another end of the resistor 222*b* is grounded.

By providing the first end portion 220*a* and the second end portion 220*b*, the energy of the high frequency signal can be consumed so that the generation of reflected waves from the ends can be prevented when the power source 190 and the electronic device 191 are not electrically connected, for example. In other words, even in a case involving Power Line Communication, in which a currently available electric power line is used as a communication line, is used for the switch device 100 and the jack connector 10 of the embodiment, reflection of the high frequency signal can be prevented when the electronic device 191 is not connected to the power source 190.

(Second Embodiment)

In this embodiment, the break portion external terminals 213*a* and 213*b* are connected to each other via a light emitting diode and a resistor instead of providing the first end portion 220*a* and the second end portion 220*b* as explained in the first embodiment.

Figure 18:
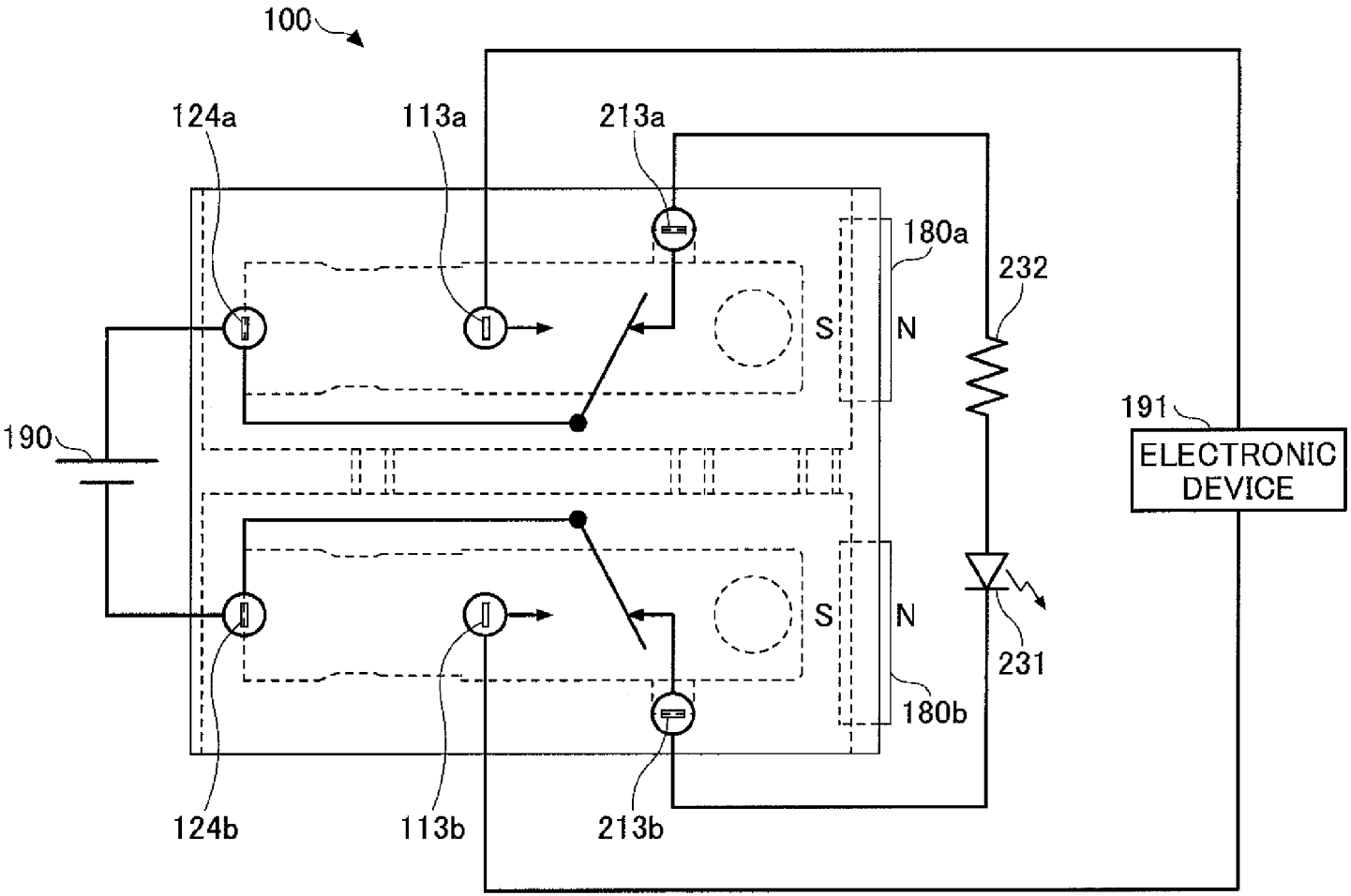
FIG. 18 is a schematic view for explaining an example of a switch device of a second embodiment.

FIG. 18 is a schematic view of an example of the switch device 100, the power source 190 and the electronic device 191 of the second embodiment.

The switch device 100 of the embodiment includes a first light emitting diode 231 and a first resistor 232 which are connected in series between the break portion external terminal 213*a* and the break portion external terminal 213*b*. Specifically, one end of the first resistor 232 is connected to the break portion external terminal 213*a*, another end of the first resistor 232 is connected to an anode terminal of the first light emitting diode 231, and a cathode terminal of the first light emitting diode 231 is connected to the break portion external terminal 213*b*.

With this structure, similar to the first embodiment, when the first movable contacting portion 121*a* is in contact with the first fixed contacting portion 111*a* as well as when the second movable contacting portion 121*b* is in contact with the second fixed contacting portion 111*b*, the electric power from the power source 190 is supplied to the electronic device 191. Under this state, the first light emitting diode 231 is not emitting.

On the other hand, when the first movable contacting portion 121*a* is in contact with the first break contacting portion 211*a* as well as when the second movable contacting portion 121*b* is in contact with the second break contacting portion 211*b*, the current flows through the first light emitting diode 231 so that the first light emitting diode 231 is emitting.

With this structure, a user or an operator can know that the electrical connection between the power source 190 and the electronic device 191 is terminated; in other words, the electric power from the power source 190 is not being supplied to the electronic device 191.

The first resistor 232 is provided to adjust the current to flow through the first light emitting diode 231 to be a predetermined current value. Thus, the first resistor 232 is designed to have a predetermined resistor value capable of adjusting the current to be the predetermined current value with respect to the voltage of the electric power from the power source 190.

(Another Structure of Switch Device)

Figure 19:
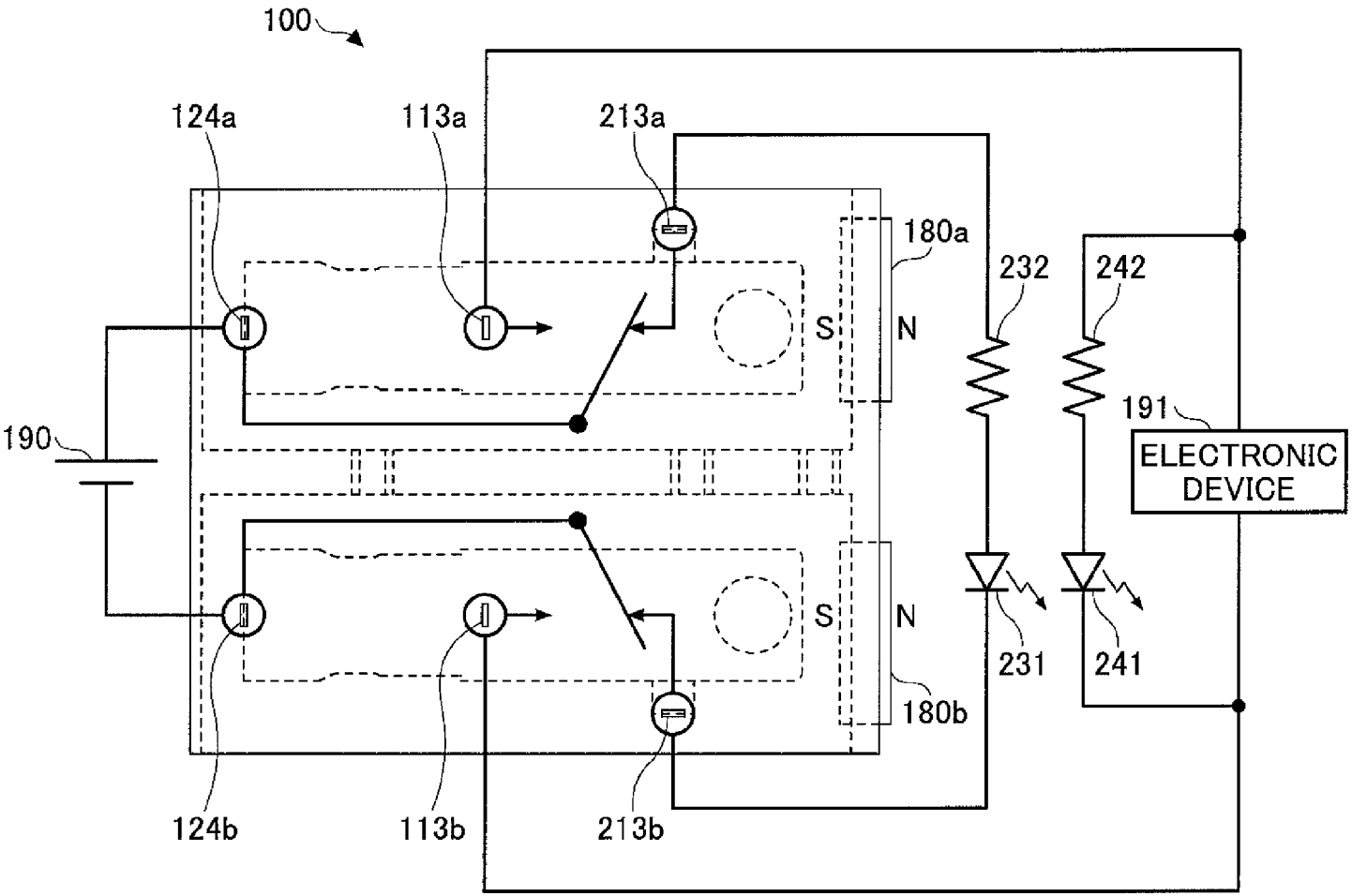
FIG. 19 is a view for explaining another example of a switch device of the second embodiment.

FIG. 19 is a schematic view of another example of the switch device 100, the power source 190 and the electronic device 191 of the second embodiment.

The switch device 100 shown in FIG. 19 further includes a second light emitting diode 241 and a second resistor 242 which are connected in series to be parallel to the electronic device 191, in addition to the first light emitting diode 231 and the first resistor 232.

Specifically, one end of the second resistor 242 is connected to the fixed portion external terminal 113*a*, another end of the second resistor 242 is connected to an anode terminal of the second light emitting diode 241, and a cathode terminal of the second light emitting diode 241 is connected to the fixed portion external terminal 113*b*.

With this structure, when the electric power from the power source 190 is supplied to the electronic device 191, the first light emitting diode 231 is not emitting but the second light emitting diode 241 is emitting.

On the other hand, when the electric power from the power source 190 is not supplied to the electronic device 191, the second light emitting diode 241 is not emitting (extinct), but the first light emitting diode 231 is emitting.

With this structure, a user or an operator can know whether the electric power is supplied from the power source 190 to the electronic device 191 based on which of the first light emitting diode 231 and the second light emitting diode 241 is emitting.

Further, by having the first light emitting diode 231 and the second light emitting diode 241 emit different colors, in other words, by changing the wavelengths of the lights emitted by the first light emitting diode 231 and the second light emitting diode 241, whether the power source 190 and the electronic device 191 are connected can be clearly known. For example, the first light emitting diode 231 may be configured to emit red light while the second light emitting diode 241 may be configured to emit blue light or the like, for example.

Figure 20:
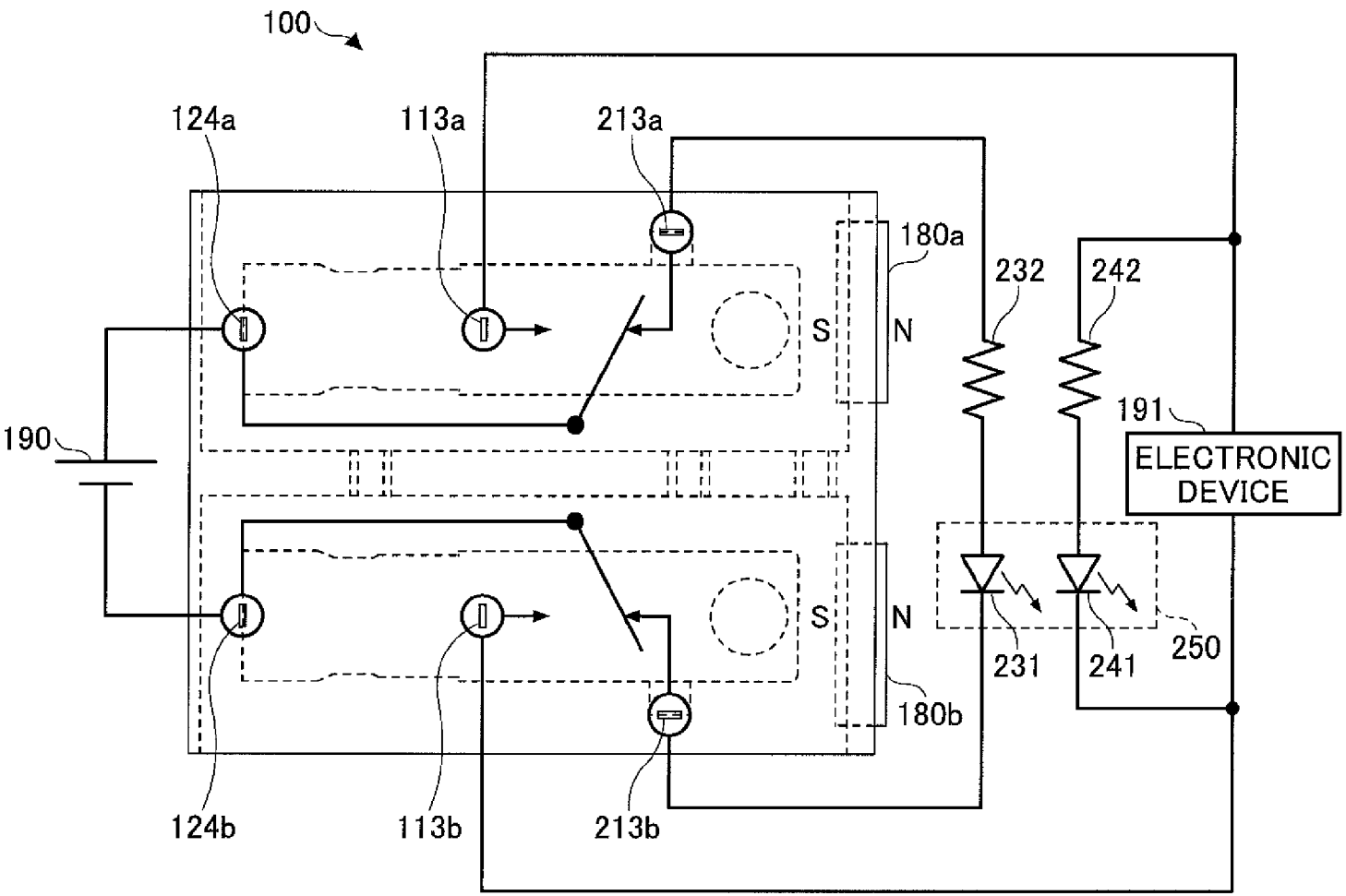
FIG. 20 is a schematic view for explaining another example of a switch device of the second embodiment.

Further, the first light emitting diode 231 and the second light emitting diode 241 may be integrally formed as shown in FIG. 20, for example. For the example shown in FIG. 20, the first light emitting diode 231 and the second light emitting diode 241 are realized by a two-color light emitting diode (LED) 250 including two LEDs emitting different colors. Specifically, the first light emitting diode 231 may be one of the LEDs of the two-color LED 250 and the second light emitting diode 241 may be the other of the LEDs of the two-color LED 250.

Other components not specifically explained in the second embodiment are similar to those of the first embodiment. Further, the switch device 100 of the second embodiment may be incorporated into the jack connector 10 explained in the first embodiment.

According to the above embodiments, a switch device, which can correspond to a power source of a voltage higher than that of the current commercial power source or a direct current power source, with high performance and reliability can be provided. Further, a connector, which can correspond to a power source of a voltage higher than that of the current commercial power source or a direct current power source and safely supply the electric power from the power source, with a high performance can be provided.

Although in the above embodiments, the jack connector 10 is explained as an example of a connector including the switch device 100, the switch device 10 may be incorporated in a plug connector.

Further, the plug connector 300 may be configured to be electrically connected to the power source side and the jack connector may be configured to be electrically connected to the electronic device side.

Further, the first movable portion 120*a* and the second movable portion 120*b* may be configured to be electrically connected to the electronic device side, and the first fixed portion 110*a* and the second fixed portion 110*b* may be configured to be electrically connected to the power source side.

Although a preferred embodiment of the connector or the switch device has been specifically illustrated and described, it is to be understood that minor modifications may be made therein without departing from the sprit and scope of the invention as defined by the claims.

In the above embodiments, the magnet unit is configured to include the first permanent magnet 180*a* and the second permanent magnet 180*b*. In other words, the first permanent magnet 180*a* and the second permanent magnet 180*b* are provided respectively for the first contacting portion 201*a* and the second contacting portion 201*b*. However, the first permanent magnet 180*a* and the second permanent magnet 180*b* may be formed to be a common magnet for the first contacting portion 201*a* and the second contacting portion 201*b*. It means that the magnet unit may include a single magnet commonly provided for the first contacting portion 201*a* and the second contacting portion 201*b*.

The present invention is not limited to the specifically disclosed embodiments, and variations and modifications may be made without departing from the scope of the present invention.

The present application is based on Japanese Priority Application No. 2011-176405 filed on Aug. 11, 2011, the entire contents of which are hereby incorporated herein by reference.

What is claimed is:

1. A switch device comprising:

a first contacting portion including a first fixed contacting portion, a first movable contacting portion and a first break contacting portion, the first movable contacting portion being configured to selectively contact one of the first fixed contacting portion and the first break contacting portion;

a second contacting portion including a second fixed contacting portion, a second movable contacting portion and a second break contacting portion, the second movable contacting portion being configured to selectively contact one of the second fixed contacting portion and the second break contacting portion, the first fixed contacting portion and the second fixed contacting portion being configured to be electrically connected to one of a power source and an electronic device while the first movable contacting portion and the second movable contacting portion are configured to be electrically connected to the other of the power source and the electronic device; and a magnet unit configured to generate magnetic fields between the first fixed contacting portion and the first movable contacting portion and between the second fixed contacting portion and the second movable contacting portion, respectively.

2. The switch device according to claim 1, wherein the first contacting portion further includes a movable spring connected to the first movable contacting portion and having a resilience to push the first movable contacting portion in a direction toward the first break contacting portion from the first fixed contacting portion, and the second contacting portion further includes a movable spring connected to the second movable contacting portion and having a resilience to push the second movable contacting portion in a direction toward the second break contacting portion from the second fixed contacting portion.

3. The switch device according to claim 1, wherein the first movable contacting portion is configured to be electrically connected to an electrode of the power source, the second movable contacting portion is configured to be electrically connected to another electrode of the power source, the first fixed contacting portion is configured to be electrically connected to a terminal of the electronic device, and the second fixed contacting portion is configured to be electrically connected to another terminal of the electronic device.

4. The switch device according to claim 1, further comprising:

a first end portion connected to the first break contacting portion and including a capacitor and a resistor connected in series; and a second end portion connected to the second break contacting portion and including a capacitor and a resistor connected in series.

5. The switch device according to claim 1, further comprising:

a first light emitting diode to be electrically connected between the first break contacting portion and the second break contacting portion.

6. The switch device according to claim 5, further comprising:

a second light emitting diode to be electrically connected between the first fixed contacting portion and the second fixed contacting portion.

7. The switch device according claim 6, wherein the colors of the lights emitted from the first light emitting diode and the second light emitting diode are different from each other.

8. The switch device according claim 6, wherein the first light emitting diode and the second emitted diode are integrally formed.

9. The switch device according to claim 3, further comprising:

a first light emitting diode and a first resistor connected in series to be electrically connected between the first break contacting portion and the second break contacting portion, and wherein the first movable contacting portion is connected to a cathode of the power source, and a terminal of the first resistor is connected to the first break contacting portion, another terminal of the first resistor is connected to an anode terminal of the first light emitting diode and a cathode terminal of the first light emitting diode is connected to the second break contacting portion.

10. The switch device according claim 9, further comprising:

a second light emitting diode and a second resistor connected in series to be electrically connected between the first fixed contacting portion and the second fixed contacting portion, and wherein a terminal of the second resistor is connected to the first fixed contacting portion, another terminal of the second resistor is connected to an anode terminal of the second light emitting diode and a cathode terminal of the second light emitting diode is connected to the second fixed contacting portion.

11. A connector for electrically connecting a power source and an electronic device, comprising:

a switch device that includes, a first contacting portion including a first fixed contacting portion, a first movable contacting portion and a first break contacting portion, the first movable contacting portion being configured to selectively contact one of the first fixed contacting portion and the first break contacting portion, a second contacting portion including a second fixed contacting portion, a second movable contacting portion and a second break contacting portion, the second movable contacting portion being configured to selectively contact one of the second fixed contacting portion and the second break contacting portion, the first fixed contacting portion and the second fixed contacting portion being configured to be electrically connected to one of a power source and an electronic device while the first movable contacting portion and the second movable contacting portion are configured to be electrically connected to the other of the power source and the electronic device, and a magnet unit configured to generate magnetic fields between the first fixed contacting portion and the first movable contacting portion and between the second fixed contacting portion and the second movable contacting portion, respectively; and a first fitting terminal and a second fitting terminal configured to be electrically connected to the first fixed contacting portion and the second fixed contacting portion or the first movable contacting portion and the second movable contacting portion, respectively, to be fitted with terminals of another connector.

12. The connector according to claim 11, further comprising:

an operation unit to be operated by an operator to be positioned at an "ON" position and an "OFF" position, and wherein the other connector is to be electrically connected to one of the electric device and the power source, and under a condition where the terminals of the other connector are physically connected to the first fitting terminal and the second fitting terminal, the switch device is configured to form an electrical connection between the power source and the electric device when the operation unit is operated to be positioned at the "ON" position and terminate the electrical connection between the power source and the electric device when the operation unit is operated to be positioned at the "OFF" position.

* * * * *